US009769882B2

(12) United States Patent
Mitsuhashi

(10) Patent No.: US 9,769,882 B2
(45) Date of Patent: Sep. 19, 2017

(54) PLANAR HEATING ELEMENT FOR WINDOW AND WINDOW FOR VEHICLE

(71) Applicant: KABUSHIKI KAISHA TOYOTA JIDOSHOKKI, Kariya-shi, Aichi-ken (JP)

(72) Inventor: Takayoshi Mitsuhashi, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 331 days.

(21) Appl. No.: 14/507,253

(22) Filed: Oct. 6, 2014

(65) Prior Publication Data

US 2015/0102023 A1 Apr. 16, 2015

(30) Foreign Application Priority Data

Oct. 10, 2013 (JP) ..... 2013-212853

(51) Int. Cl.
*H05B 3/84* (2006.01)
*H05B 3/56* (2006.01)
*H05B 3/20* (2006.01)

(52) U.S. Cl.
CPC ..... *H05B 3/84* (2013.01); *H05B 3/20* (2013.01); *H05B 3/56* (2013.01); *H05B 2203/007* (2013.01); *H05B 2203/011* (2013.01); *H05B 2203/013* (2013.01); *H05B 2203/014* (2013.01);
(Continued)

(58) Field of Classification Search
CPC ... H05B 3/84; H05B 3/20; H05B 3/56; H05B 3/86; H05B 3/54; H05B 2203/007; H05B 2203/011; H05B 2203/013; H05B 2203/014; H05B 2203/033; H05B 2203/008; H05B 2203/031; H05B 2203/037
See application file for complete search history.

(56) References Cited

U.S. PATENT DOCUMENTS 3,266,005 A 8/1966 Balde et al.
5,019,797 A 5/1991 Marstiller et al.

FOREIGN PATENT DOCUMENTS

DE 4019357 C1 8/1991
EP 1404153 * 3/2004
EP 1404153 A1 3/2004
(Continued)

OTHER PUBLICATIONS

Communication dated Feb. 20, 2015 from the European Patent Office in counterpart application No. 14188070.8.
(Continued)

*Primary Examiner* — Shawntina Fuqua
(74) *Attorney, Agent, or Firm* — Sughrue Mion, PLLC

(57) ABSTRACT

A planar heating element for a window includes a resin base having a flat or curved surface, a heating element formed of a conductive sheet having a uniform specific resistance and provided to spread in the form of a planar shape along the shape of the surface of the resin base, and conductive current supply portions provided to extend in the form of bands on opposite ends of the heating element, so as to allow a current to pass through the heating element. The heating element has a locally increased specific resistance portion whose specific resistance locally increases when a current is passed through the heating element from the current supply portions.

7 Claims, 8 Drawing Sheets

(52) U.S. Cl.
CPC .. *H05B 2203/033* (2013.01); *H05B 2203/037* (2013.01)

(56) References Cited

FOREIGN PATENT DOCUMENTS

| | | | |
|---|---|---|---|
| EP | 1845018 | * | 10/2007 |
| EP | 1845018 | A2 | 10/2007 |
| EP | 1908584 | A1 | 4/2008 |
| JP | 60-195254 | U | 12/1985 |
| JP | 4229983 | A | 8/1992 |
| JP | 4-50203 | Y2 | 11/1992 |
| JP | 2010251230 | A | 11/2010 |

OTHER PUBLICATIONS

Communication dated May 29, 2015 from the European Patent Office issued in corresponding application No. 14188070.8.

* cited by examiner

PLANAR HEATING ELEMENT FOR WINDOW AND WINDOW FOR VEHICLE

This nonprovisional application is based on Japanese Patent Application No. 2013-212853 filed on Oct. 10, 2013, with the Japan Patent Office, the entire contents of which are hereby incorporated by reference.

BACKGROUND OF THE INVENTION

Field of the Invention

The present invention relates to a planar heating element for a window and a window for a vehicle.

Description of the Background Art

A defogger for removing mist or frost from a window is conventionally attached to the surface of a window of an automobile. Particularly as a defogger for attachment to the surface of a rear window of an automobile, a heating wire-type defogger formed of conductive wires as a heating element is used. An electric heating window pane, which is configured to generate heat when a current is passed through electrode wires embedded in a window pane of a vehicle such as an automobile, is also known.

PTD 1 (Japanese Examined Utility Model Publication No. 4-50203), for example, describes a rear window glass for an automobile configured such that the specific resistance of the transparent conductive thin film is varied depending on the place, in order to preferentially demist or defrost a portion that urgently needs to become visible (see, for example, columns 3, 6 and 7 of PTD 1).

FIG. 18 illustrates a schematic plan view of the conventional rear window glass for an automobile described in PTD 1. The rear window glass for an automobile described in PTD 1 has a structure in which each of opposite sides of a transparent conductive thin film 100 serving as a heating element is provided with an electrode 104 for supplying a current to the transparent conductive thin film 100. In this structure, an upper portion 101 and a lower portion 103 of the transparent conductive thin film 100 have a low specific resistance, and an intermediate portion 102 between the upper portion 101 and the lower portion 103 has a high specific resistance. According to PTD 1, when the rear window glass for an automobile described in PTD 1 having this structure was misted with a spray of stream and then a current was supplied to the transparent conductive thin film 100, the rear window glass was demisted in a short time, with the intermediate portion 102 having a high specific resistance of the transparent conductive thin film 100 being the center (see, for example, column 7 of PTD 1).

The rear window glass for an automobile described in PTD 1 is fabricated as follows (see, for example, columns 6 and 7 of PTD 1). First, a transparent substrate having the shape of a rear window glass for an automobile is washed well with an organic solvent and pure water. Then, a silver paste containing a glass frit as the electrode 104 is screen-printed on each of the upper and lower sides of the transparent substrate, dried and then baked.

Next, the entire transparent substrate is placed in a sputtering vacuum chamber, where the transparent conductive thin film 100 is formed on the surface of the transparent substrate by sputtering. Next, laser beam heating is conducted such that the heating temperature for the intermediate portion 102 of the transparent conductive thin film 100 becomes lower than the heating temperature for the upper portion 101 and the lower portion 103. Consequently, the rear window glass for an automobile described in PTD 1 in which the specific resistance of the intermediate portion 102 of the transparent conductive thin film 100 is higher than the specific resistance of the upper portion 101 and the lower portion 103 is fabricated.

SUMMARY OF THE INVENTION

As described above, in the rear window glass for an automobile described in PTD 1, a region with a high specific resistance (the intermediate portion 102) and a region with a low specific resistance (the upper portion 101 and the lower portion 103) are separately formed by varying the temperature of heating the transparent conductive thin film 100 through laser beam radiation.

The method described in PTD 1, however, cannot be used when a resin base such as polyacrylonitrile, polycarbonate, or the like is used as the transparent substrate of the rear window glass for an automobile described in PTD 1, because the transparent substrate is softened if the temperature of heating the transparent conductive thin film 100 through laser beam radiation is increased to 130° C. or higher.

In view of the foregoing circumstances, an object of the present invention is to provide a planar heating element for a window in which a resin base is used, and a desired place can be preferentially heated and then the entire surface can be heated, and also provide such a window for a vehicle.

A first aspect as one example of the present invention provides a planar heating element for a window including a resin base having a flat or curved surface; a heating element formed of a conductive sheet having a uniform specific resistance, the heating element being provided to spread in the form of a planar shape along a shape of the surface of the resin base; and a conductive current supply portion provided to extend in the form of a band on each of opposite ends of the heating element, so as to allow a current to pass through the heating element, the heating element having a locally increased specific resistance portion whose specific resistance locally increases when a current is passed through the heating element from the current supply portion.

A second aspect as one example of the present invention provides a window for a vehicle including the planar heating element for a window according to the first aspect of the present invention.

The foregoing aspects provide a planar heating element for a window in which a resin base is used, and a desired place can be preferentially heated and then the entire surface can be heated, and also provide such a window for a vehicle.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
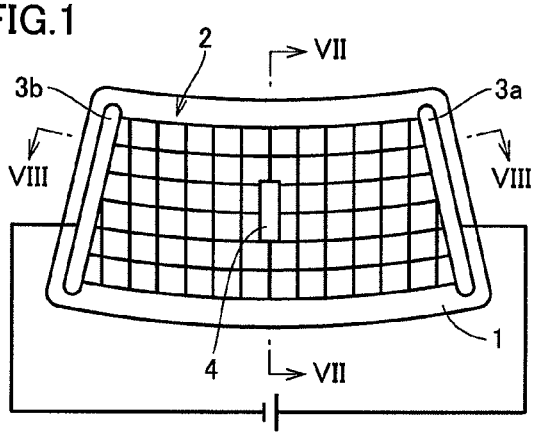
FIG. 1 is a schematic plan view of a rear surface of a planar heating element for a window according to a first embodiment.

Embodiments of the present invention will be described below by way of example. In the drawings used to describe the embodiments, the same reference numerals indicate the same or corresponding portions.

First Embodiment

Structure of Planar Heating Element for Window

FIG. 1 is a schematic plan view of a rear surface of a planar heating element for a window according to a first embodiment, as one example of the present invention. As shown in FIG. 1, the planar heating element for a window according to the first embodiment includes a resin base 1 made of polycarbonate, a heating element 2 formed of a conductive sheet having a uniform specific resistance and provided on the resin base 1 to spread in the form of a planar shape along the shape of a surface of the resin base 1, conductive current supply portions 3*a*, 3*b*, each extending in the form of a band on each of opposite ends of the heating element 2 (in this embodiment, the opposite ends in the horizontal direction of FIG. 1), and a heat dissipation-preventing member 4 centrally provided on the surface of the heating element 2.

The resin base 1 may have either a flat surface or a curved surface. The resin base 1 is provided with the heating element 2 on a rear surface opposite to a front surface of the resin base 1. Each of the current supply portions 3*a*, 3*b* is provided to extend in the form of a band along each of the opposite ends of the heating element 2, so as to allow a current to pass through the heating element 2. The heat dissipation-preventing member 4 has a band shape, and is centrally arranged on the surface of the heating element 2 to extend in a direction orthogonal to a direction of current flow (in this embodiment, the vertical direction of FIG. 1).

In the planar heating element for a window according to the first embodiment, a current is supplied to the heating element 2 from the current supply portion 3*a* or the current supply portion 3*b*. With the current supplied to the heating element 2 from the current supply portion 3*a* or the current supply portion 3*b*, the heating element 2 generates heat owing to its own electrical resistance. The heat generated on the heating element 2 is then transferred to the surface of the resin base 1 to heat the surface of the planar heating element for a window.

Figure 2:
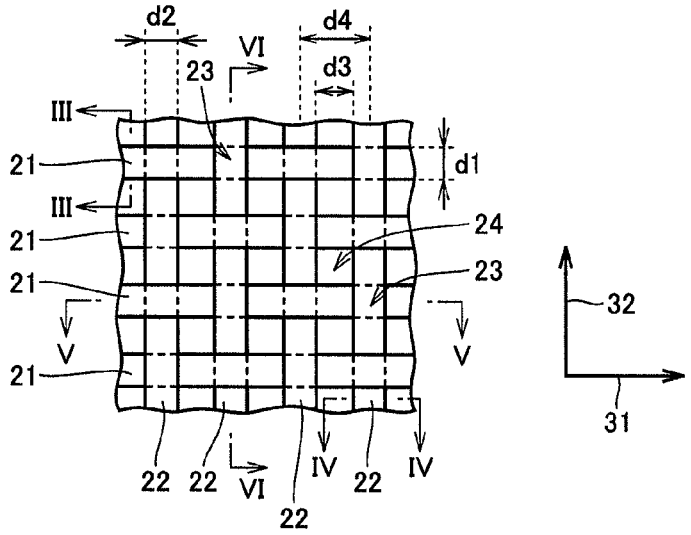
FIG. 2 is a schematic enlarged plan view of a conductive mesh, as one example of a conductive sheet having a uniform specific resistance for use in a heating element of the planar heating element for a window according to the first embodiment.

FIG. 2 illustrates a schematic enlarged plan view of a conductive mesh, as one example of a conductive sheet having a uniform specific resistance for use in the heating element 2 of the planar heating element for a window according to the first embodiment. The conductive mesh has a plurality of first conductive wires 21 and a plurality of second conductive wires 22. The first conductive wires 21 extend in a first direction 31 at a distance from one another, and the second conductive wires 22 extend in a second direction 32 different from the first direction 31 at a distance from one another.

The first conductive wires 21 and the second conductive wires 22 intersect with one another to form a plurality of openings 24. In the first embodiment, a single first conductive wire 21 is fixed to each of the plurality of second conductive wires 22 at intersections 23, and a single second conductive wire 22 is fixed to each of the plurality of first conductive wires 21 at the intersections 23. An opening 24 is defined by the region of a gap surrounded with two adjacent first conductive wires 21 and two adjacent second conductive wires 22.

The opening ratio of the conductive mesh is preferably 70% or higher, but is not particularly limited thereto. The opening ratio of 70% or higher of the conductive mesh can reduce the visibility of the first conductive wires 21 and the second conductive wires 22 when the planar heating element for a window according to the first embodiment is seen from the resin base 1-side. Thus, the transparency (the property of transmitting at least a portion of visible light (wavelength: 360 to 830 nm); the transparency becomes higher as the transmittance of visible light improves) of the planar heating element for a window according to the first embodiment can be improved. In this case, therefore, the planar heating element for a window according to the first embodiment can be suitably used as a window for a vehicle with a defogger function that requires transparency, such as a rear window of an automobile, for example.

The opening ratio [%] of the conductive mesh can be calculated using a known equation. The opening ratio can be calculated using, for example, the following equation (I):

$$\text{Opening ratio [\%] of conductive mesh} = 100\times\{(d3)/(d4)\}^2 \quad \text{(I)}$$

where d3 represents an inner dimension between two adjacent conductive wires, and d4 represents a distance between the centers of two adjacent conductive wires.

Figure 3:
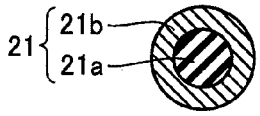
FIG. 3 is a schematic cross-sectional view along III-III in FIG. 2.

FIG. 3 illustrates a schematic cross-sectional view along III-III in FIG. 2. As shown in FIG. 3, the first conductive wire 21 has a first core wire 21*a* made of polyester and a first coating material 21*b* made of copper that coats an outer surface of the first core wire 21*a*. Each of the first core wire 21*a* and the first coating material 21*b* may be composed of a single layer alone, or composed of a plurality of layers. When the first core wire 21*a* and/or the first coating material 21*b* are/is composed of a plurality of layers, each of the plurality of layers may be made of the same material, or at least one of the layers may be made of a different material.

A thickness d1 of the first conductive wire 21 shown in FIG. 2 is preferably 0.3 mm or less, more preferably 0.2 mm or less, and still more preferably 0.08 mm or less, but is not particularly limited thereto. As the thickness d1 of the first conductive wire 21 is changed to 0.3 mm or less, 0.2 mm or less, and 0.08 mm or less, the first conductive wire 21 can be thinner, allowing the visibility of the first conductive wires 21 when the planar heating element for a window according to the first embodiment is seen from the front surface-side of the resin base 1 to decrease. Consequently, the transparency of the planar heating element for a window according to the first embodiment can be improved. In this case also, therefore, the planar heating element for a window according to the first embodiment can be suitably used as a window for a vehicle with a defogger function that requires transparency, such as a rear window of an automobile, for example. It is noted that as shown in FIG. 2, for example, the thickness d1 of the first conductive wire 21 is a length in a direction orthogonal to the direction in which the first conductive wires 21 extend (the first direction 31) on the surface of the conductive mesh.

Figure 4:
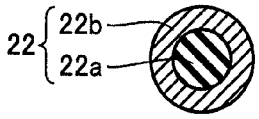
FIG. 4 is a schematic cross-sectional view along IV-IV in FIG. 2.

FIG. 4 illustrates a schematic cross-sectional view along IV-IV in FIG. 2. As shown in FIG. 4, the second conductive wire 22 has a second core wire 22*a* made of polyester and a second coating material 22*b* made of copper that coats an outer surface of the second core wire 22*a*. Each of the second core wire 22*a* and the second coating material 22*b* may be composed of a single layer alone, or composed of a plurality of layers. When the second core wire 22*a* and/or the second coating material 22*b* are/is composed of a plurality of layers, each of the plurality of layers may be made of the same material, or at least one of the layers may be made of a different material.

A thickness d2 of the second conductive wire 22 shown in FIG. 2 is preferably 0.3 mm or less, more preferably 0.2 mm or less, and still more preferably 0.08 mm or less, but is not particularly limited thereto. As the thickness d2 of the second conductive wire 22 is changed to 0.3 mm or less, 0.2 mm or less, and 0.08 mm or less, the second conductive wire 22 can be thinner, allowing the visibility of the second conductive wires 22 when the planar heating element for a window according to the first embodiment is seen from the front surface-side of the resin base 1 to decrease. Consequently, the transparency of the planar heating element for a window according to the first embodiment can be improved. In this case also, therefore, the planar heating element for a window according to the first embodiment can be suitably used as a window for a vehicle with a defogger function that requires transparency, such as a rear window of an automobile, for example. It is noted that as shown in FIG. 2, for example, the thickness d2 of the second conductive wire 22 is a length in a direction orthogonal to the direction in which the second conductive wires 22 extend (the second direction 32) on the surface of the conductive mesh.

Figure 5:
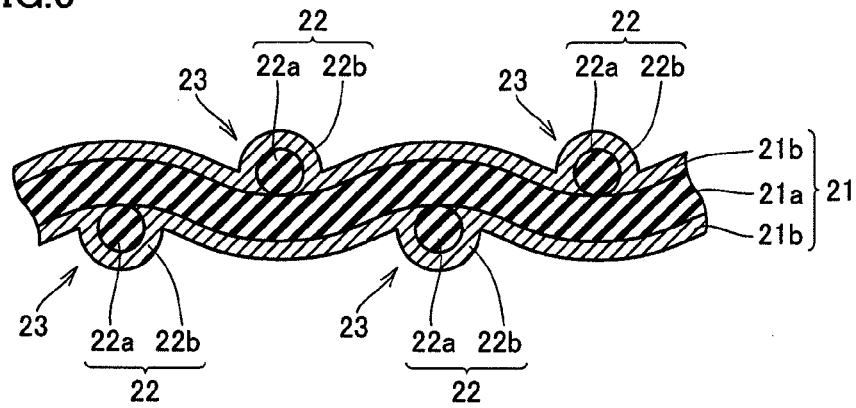
FIG. 5 is a schematic cross-sectional view along V-V in FIG. 2.
Figure 6:
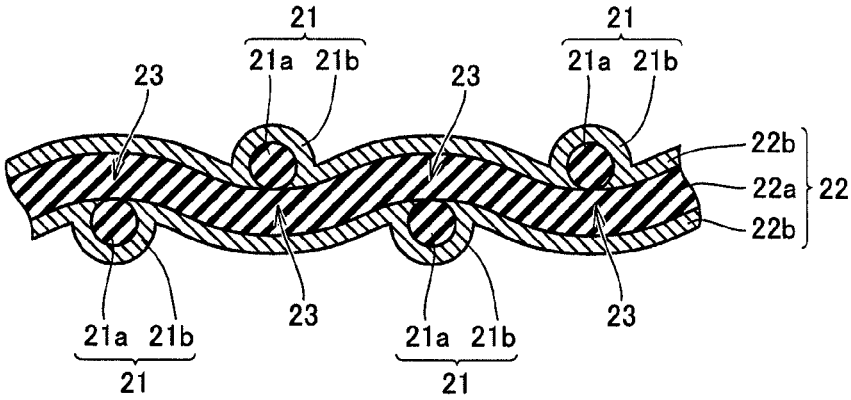
FIG. 6 is a schematic cross-sectional view along VI-VI in FIG. 2.

FIG. 5 illustrates a schematic cross-sectional view along V-V in FIG. 2, and FIG. 6 illustrates a schematic cross-sectional view along VI-VI in FIG. 2. As shown in FIGS. 5 and 6, the first conductive wires 21 and the second conductive wires 22 are fixed to one another at their intersections 23, through thermal fusion of the first core wires 21*a* and the second core wires 22*b*.

While the method of fixing the first conductive wires 21 and the second conductive wires 22 is not limited to fixing through the thermal fusion of the first core wires 21*a* and the second core wires 22*b*, fixing the first conductive wires 21 and the second conductive wires 22 through thermal fusion of the first core wires 21*a* and the second core wires 22*b* is preferred, because the first conductive wires 21 and the second conductive wires 22 can be firmly fixed without using other material such as an adhesive or the like, for fixing the first conductive wires 21 and the second conductive wires 22.

Figure 7:
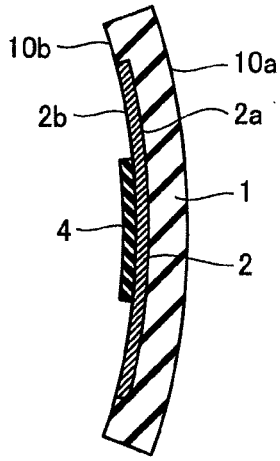
FIG. 7 is a schematic cross-sectional view along VII-VII in FIG. 1.

FIG. 7 illustrates a schematic cross-sectional view along VIII-VIII in FIG. 1. As shown in FIG. 7, in the planar heating element for a window according to the first embodiment, the heating element 2 is embedded within the resin base 1 on the inner side of a rear surface 10*b* of the resin base 1. The heating element 2 is arranged such that a front surface 2*a* of the heating element 2 spreads in the form of a planar shape along the shape of the surface 10*a* of the resin base 1, and is also arranged to extend in a direction vertical to the sheet surface of FIG. 7. The heat dissipation-preventing member 4 is further installed on a rear surface 2*b* opposite to the front surface 2*a* of the heating element 2.

The member for use as the heat dissipation-preventing member 4 is not particularly limited so long as it can prevent heat generated from the heating element 2 with the supply of a current to the heating element 2 from escaping outside. For example, a conventionally known thermal storage material can be used.

Figure 8:
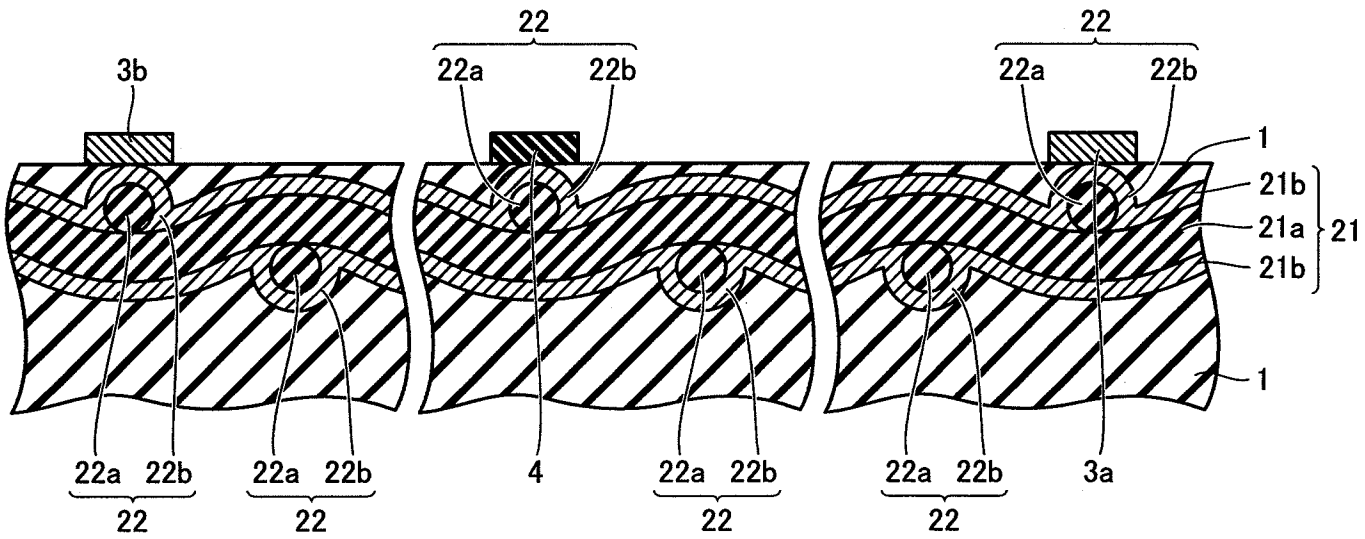
FIG. 8 is a schematic enlarged cross-sectional view along VIII-VIII in FIG. 1.

FIG. 8 is a schematic enlarged cross-sectional view along VIII-VIII in FIG. 1. As shown in FIG. 8, the first conductive wire 21 and the second conductive wire 22 are buried in the resin base 1. Thus, the intersection 23 of the first conductive wire 21 and the second conductive wire 22 of the conductive mesh 2, and the opening 24 are also buried in the resin base 1. The current supply portions 3*a*, 3*b* are installed in contact with the surface of the second coating material 22*b* of the second conductive wires 22 on the opposite ends of the conductive mesh 2, and the heat dissipation-preventing member 4 is centrally installed on the surface of the conductive mesh 2. The present invention, however, is not limited to this structure.

<Method for Manufacturing Planar Heating Element for Window>

Figure 9:
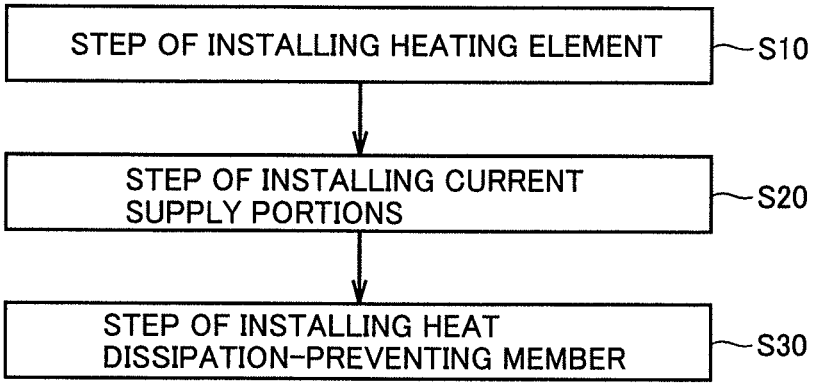
FIG. 9 is a flow chart of one example of a method for manufacturing the planar heating element for a window according to the first embodiment.

FIG. 9 is a flow chart illustrating one example of a method for manufacturing the planar heating element for a window according to the first embodiment. As shown in FIG. 9, the method for manufacturing the planar heating element for a window according to the first embodiment includes a step of installing the heating element (S10), a step of installing the current supply portions (S20), and a step of installing the heat dissipation-preventing member (S30). The step of installing the heating element (S10), the step of installing the current supply portions (S20), and the step of installing the heat dissipation-preventing member (S30) are performed in this order. It is noted that the method for manufacturing the planar heating element for a window according to the first embodiment may include a step other than foregoing steps S10 to S30, and the order of the steps is not particularly limited. For example, the step of installing the heat dissipation-preventing member (S30) may be followed by the step of installing the heating element (S10) and the step of installing the current supply portions (S20) in this order.

<<Step of Installing Heating Element>>

The step of installing the heating element (S10) is performed by installing, on the resin base 1, the heating element 2 formed of a conductive sheet having a uniform specific resistance to spread in the form of a planar shape along the shape of the surface 10*a* of the resin base 1. The heating element 2 can be installed on the rear surface 10*b* of the resin base 1 by, for example, insert molding described in detail below.

Figure 10:
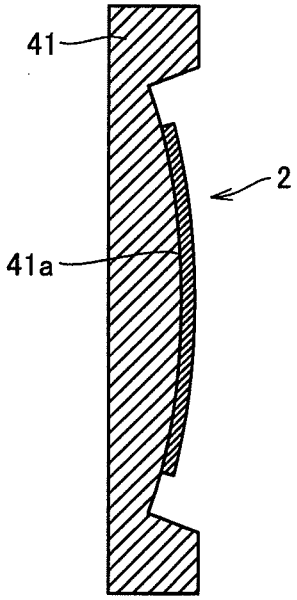
FIG. 10 is a schematic cross-sectional view illustrating part of a step of installing the heating element in the method for manufacturing the planar heating element for a window according to the first embodiment.

First, as shown in the schematic cross-sectional view in FIG. 10, for example, the heating element 2 is installed along a concave bottom surface 41*a* of a mold 41. At this time, the heating element 2 is installed along the concave bottom surface 41*a* of the mold 41.

The concave shape of the mold 41 can be set as appropriate in accordance with the shape of the planar heating element for a window according to the first embodiment. For example, when the concave bottom surface 41*a* of the mold 41 is flat, the rear surface 10*b* of the resin base 1 of the planar heating element for a window according to the first embodiment can be flat. When the concave bottom surface 41*a* of the mold 41 is curved, the rear surface 10*b* of the resin base 1 of the planar heating element for a window according to the first embodiment can be curved.

Figure 11:
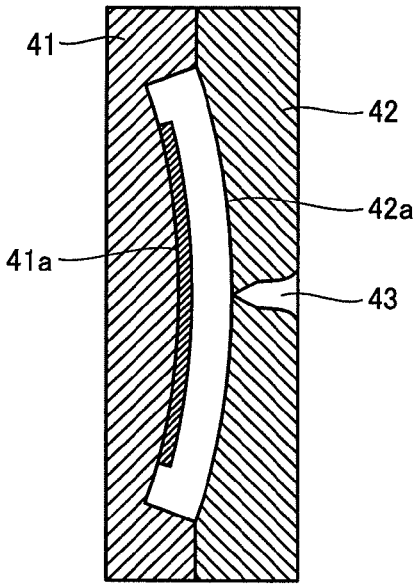
FIG. 11 is a schematic cross-sectional view illustrating part of the step of installing the heating element in the method for manufacturing the planar heating element for a window according to the first embodiment.

Next, as shown in the schematic cross-sectional view in FIG. 11, for example, another mold 42 with an inlet for liquid resin is installed on the concave-side of the mold 41. It is noted that the shape of a surface 42*a* of the mold 42 facing the mold 41 can be set as appropriate in accordance with the shape of the planar heating element for a window according to the first embodiment. For example, when the surface 42*a* of the mold 42 is flat, the surface 10*a* of the resin base 1 of the planar heating element for a window according to the first embodiment can be flat. When the surface 42*a* of the mold 42 is curved, the surface 10*a* of the resin base 1 of the planar heating element for a window according to the first embodiment can be curved.

Figure 12:
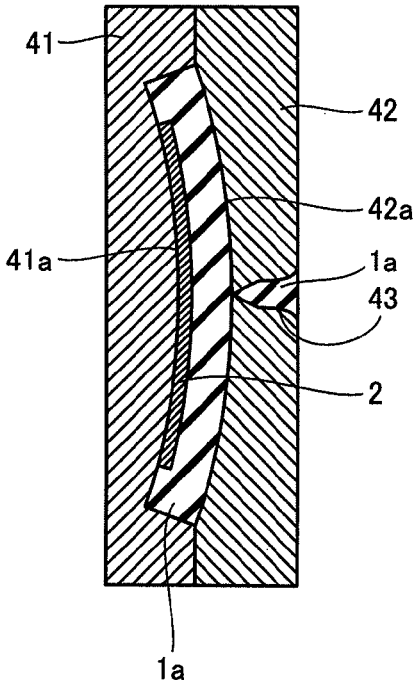
FIG. 12 is a schematic cross-sectional view illustrating part of the step of installing the heating element in the method for manufacturing the planar heating element for a window according to the first embodiment.

Next, as shown in the schematic cross-sectional view in FIG. 12, for example, liquid resin 1*a* is introduced into the concave portion of the mold 41 through an inlet 43 of the mold 42. The liquid resin 1*a* is introduced to permeate throughout the heating element 2 and contain the entire heating element 2 therein. As the liquid resin 1*a*, a material that forms the resin base 1 through curing is used. For example, liquid polycarbonate can be used.

Figure 13:
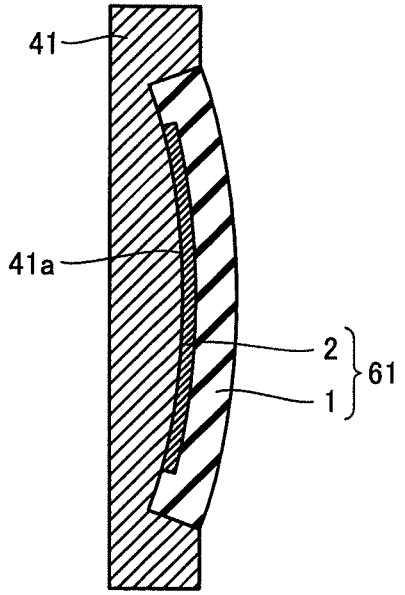
FIG. 13 is a schematic cross-sectional view illustrating part of the step of installing the heating element in the method for manufacturing the planar heating element for a window according to the first embodiment.

Next, as shown in the schematic cross-sectional view in FIG. 13, for example, a conductive substrate 61 is formed by curing the liquid resin 1*a* introduced into the concave portion of the mold 41 by cooling. The conductive substrate 61 is formed by integration of the resin base 1 formed of the cured liquid resin 1*a* with the heating element 2. It is noted that the method of curing the liquid resin 1*a* is not limited to the above-described method using cooling. A method suitable for the properties of the liquid resin 1*a* can be used as appropriate.

Figure 14:
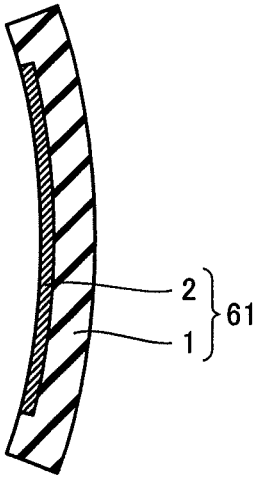
FIG. 14 is a schematic cross-sectional view illustrating part of the step of installing the heating element in the method for manufacturing the planar heating element for a window according to the first embodiment.

Next, as shown in the schematic cross-sectional view in FIG. 14, for example, the conductive substrate 61 formed as described above is released from the mold 41. It is noted that the method of releasing the conductive substrate 61 from the mold 41 is not particularly limited, and a conventionally known method can be used as appropriate.

<<Step of Installing Current Supply Portions>>

The step of installing the current supply portions (S20) is performed by installing the conductive current supply portions 3*a*, 3*b* to extend in the form of bands on the opposite ends of the heating element 2, so as to allow a current to pass through the heating element 2. The step of installing the current supply portions (S20) can be performed by electrically and mechanically connecting the current supply portions 3*a*, 3*b* to be in contact with an outer surface of the second coating material 22*b* of the second conductive wires 22 on the opposite ends of the heating element 2, as shown in the schematic cross-sectional view in FIG. 8, for example.

It is noted that the method of connecting the current supply portions 3*a*, 3*b* is not particularly limited. For example, the current supply portions 3*a*, 3*b* can be connected using a conductive adhesive such as solder or the like.

<<Step of Installing Heat Dissipation-Preventing Member>>

The step of installing the heat dissipation-preventing member (S30) can be performed by installing the heat dissipation-preventing member 4 on a portion of the surface of the heating element 2 such that it can prevent escape of heat generated from the heating element 2 with the supply of a current to the heating element 2 from the current supply portion 3*a*. The step of installing the heat dissipation-preventing member (S30) can be performed by installing the heat dissipation-preventing member 4 to be in contact with the outer surface of the second coating material 22*b* of the second conductive wires 22 in the center of the heating element 2, as shown in the schematic cross-sectional view in FIG. 8, for example.

It is noted that the method of installing the heat dissipation-preventing member 4 is not particularly limited. For example, the heat dissipation-preventing member 4 can be installed by bonding with a conventionally known insulating adhesive.

<Effects>

In the planar heating element for a window according to the first embodiment, as shown in FIG. 1, the heat dissipation-preventing member 4 is locally installed in the center of the rear surface of the heating element 2 to prevent heat generated from the heating element 2 with the supply of a current to the heating element 2 from escaping outside. Thus, when a current is supplied to the heating element 2 from the current supply portion 3*a* or the current supply portion 3*b*, a central region on the rear surface of the heating element 2 where the heat dissipation-preventing member 4 is installed (hereinafter referred to as the "rear surface central region) is more unlikely to cause heat generated from the heating element 2 to escape outside than regions on both sides thereof (the regions on the both sides of the heat dissipation-preventing member 4 in the vertical direction of FIG. 1). The temperature of the rear surface central region is thus locally increased.

The increase in temperature on the rear surface central region causes the specific resistance of the rear surface central region to locally increase. Thus, when a uniform current passes throughout the heating element 2, the amount of heat generated on the rear surface central region having the increased specific resistance is greater than the amount of heat generated on the regions other than the rear surface central region. In this way, only the central portion of the surface of the planar heating element for a window according to the first embodiment, which corresponds to the rear surface central region of the heating element 2, can be locally heated.

In accordance with the Ohm's law, the amount of heat Q can be expressed by the product of the square of current I and specific resistance R ($Q=I^2\times R$); therefore, the amount of heat generated on the rear surface central region having a high specific resistance can be locally increased.

Figure 15:
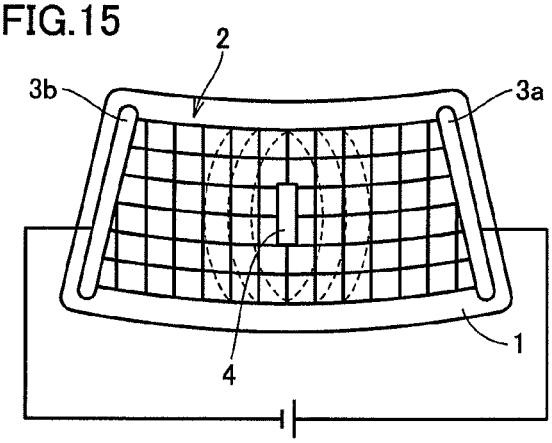
FIG. 15 is a schematic plan view illustrating an effect of the planar heating element for a window according to the first embodiment.

Thereafter, as shown in FIG. 15, places other than the central portion of the surface of the planar heating element for a window according to the first embodiment region are also heated to heat the entire surface of the planar heating element for a window according to the first embodiment.

Furthermore, the planar heating element for a window according to the first embodiment does not require the step of heating to a high temperature, e.g., 130° C. or higher, with a laser beam as in the conventional method described in PTD 1. The resin base 1 can therefore be used as the base.

For the foregoing reasons, the first embodiment provides a planar heating element for a window in which the resin base 1 is used, and a desired place can be preferentially heated and then the entire surface can be heated, and also provides a method for manufacturing such a planar heating element for a window.

It is noted that in conventional PTD 1, the specific resistance of the heating element is locally increased in advance before supplying a current, thereby locally increasing the amount of heat generated on the place having a high specific resistance of the heating element. In contrast, in the first embodiment, by utilizing the temperature dependence of specific resistance, the specific resistance of the heating element 2 is not changed before supplying a current, but is locally increased during supply of a current to thereby locally increase the amount of heat generated. The technical concept of the first embodiment is therefore completely different from that of conventional PTD 1.

In the planar heating element for a window according to the first embodiment, a 10° C. increase in the temperature of the heating element 2 causes the electrical resistance of the heating element 2 to increase by 3% to 5%. Therefore, when a difference in temperature of 10° C. to 20° C. is produced between the region where the heat dissipation-preventing member 4 is installed and the other regions within a period of 60 seconds from the supply of a current to the heating element 2, the effect of urgently providing the visibility of the surface of the planar heating element for a window according to the first embodiment through local generation of heat can become more pronounced.

Other Embodiments

While the foregoing has described the case where the resin base 1 is made of polycarbonate, a resin other than polycarbonate can be used as the resin base 1 without being limited to polycarbonate. It is, however, preferred that the resin base 1 contain polycarbonate. The use of polycarbonate as the resin base 1 allows the transparency and the durability of the resin base 1 to improve.

While the foregoing has described the case where the first core wire 21*a* of the first conductive wire 21 and the second core wire 22*a* of the second conductive wire 22 are made of polyester, a suitable material such as a resin, a glass, or a metal, for example, can be used without being limited to polyester. The first core wire 21*a* and the second core wire 22*a* are particularly preferably made of the same resin. In this case, the first conductive wires 21 and the second conductive wires 22 can be firmly fixed through thermal fusion of the first core wires 21*a* and the second core wires 22*a*.

While the foregoing has described the case where the first coating material 21*b* of the first conductive wire 21 and the second coating material 22*b* of the second conductive wire 22 are made of copper, a suitable conductive material such as a metal layer made of a two-layer structure with copper and a metal other than copper, for example, can be used without being limited to copper.

While the foregoing has described the case where the first conductive wires 21 and the second conductive wires 22 are fixed through thermal fusion of the first core wires 21*a* and the second core wires 22*a*, the first conductive wires 21 and the second conductive wires 22 may not be fixed to one another. Alternatively, for example, the first conductive wires 21 extending in the first direction 31 and the second conductive wires 22 extending in the second direction 32 different from the first direction 31 may be woven by plain weave, twill, or the like.

While the foregoing has described the conductive mesh having the plurality of openings 24 as one example of the heating element 2, the heating element 2 may be any conductive sheet having a uniform specific resistance, for example, a transparent conductive film such as an ITO (Indium Tin Oxide) film without an opening. It is noted that the specific resistance of the conductive sheet having a uniform specific resistance may be substantially uniform throughout the conductive sheet, and may not necessarily be completely uniform.

The heating element 2 such as a conductive mesh, a transparent conductive film, or the like may be entirely buried within the resin base 1 on the inner side of the rear surface 10*b* of the resin base 1, or may be at least partially exposed outside through the rear surface 10*b* of the resin base 1.

The current supply portion 3 is not particularly limited so long as it can pass a current through the heating element 2 such as a conductive mesh, a transparent conductive film, or the like. A suitable conductive material such as a metal, for example, can be used.

Second Embodiment

Figure 16:
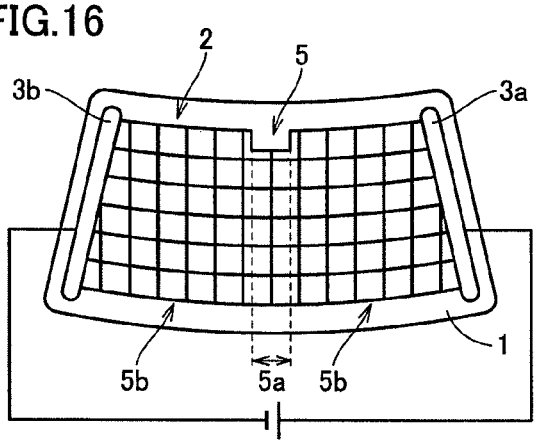
FIG. 16 is a schematic plan view of a rear surface of a planar heating element for a window according to a second embodiment.

FIG. 16 is a schematic plan view of a rear surface of a planar heating element for a window according to a second embodiment, as another example of the present invention. The planar heating element for a window according to the second embodiment has a feature in having a notch 5 formed by cutting out a portion of the heating element 2.

In the planar heating element for a window according to the second embodiment, a central region of the rear surface of the heating element 2 where the notch 5 is formed by cutting a portion of a peripheral edge of the heating element 2 (the region of the heating element 2 adjacent to the notch 5 in a direction orthogonal to the direction of current flow in the heating element 2; hereinafter referred to as the "rear surface central region 5*a*") is smaller in width in the heating element 2 (the width in the vertical direction of FIG. 16) than regions 5*b* on both sides thereof (the regions of the heating element 2 on both sides of the notch 5 in the horizontal direction of FIG. 16). Consequently, the specific resistance of the rear surface central region 5*a* of the heating element 2 is locally increased.

Thus, when a current is supplied from the current supply portion 3*a* or the current supply portion 3*b* of the planar heating element for a window according to the second embodiment, a uniform current flows throughout the heating element 2, and the amount of heat generated on the rear surface central region 5*a* having an increased specific resistance is greater than the amount of heat generated on the regions 5*b* other than the rear surface central region. In this way, only a central portion of the surface of the planar heating element for a window according to the second embodiment, which corresponds to the rear surface central region 5*a*, can be locally heated.

Figure 17:
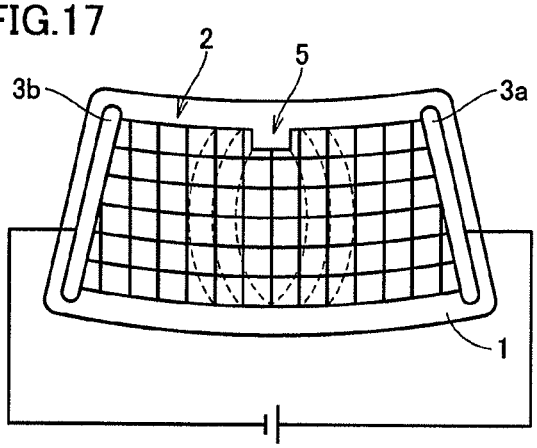
FIG. 17 is a schematic plan view illustrating an effect of the planar heating element for a window according to the second embodiment.
Figure 18:
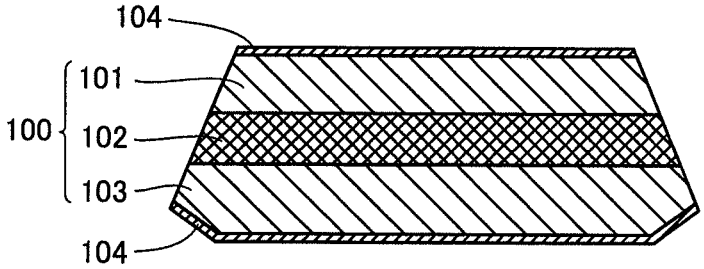
FIG. 18 illustrates a schematic plan view of the conventional rear window glass for an automobile described in PTD 1.

Thereafter, as shown in FIG. 17, places other than the central portion of the surface of the planar heating element for a window according to the second embodiment are also heated to heat the entire surface of the planar heating element for a window according to the second embodiment.

Furthermore, in the planar heating element for a window according to the second embodiment, the notch 5 can be easily formed by cutting the conductive mesh 2, for example. This eliminates the need for the step of heating to a high temperature, e.g., 130° C. or higher, with a laser beam as in the conventional method described in PTD 1. The resin base 1 can therefore be used as the base.

For the foregoing reasons, the second embodiment also provides a planar heating element for a window in which the resin base 1 is used, and a desired place can be preferentially heated and then the entire surface can be heated.

The second embodiment is also advantageous in that it does not require the use of another member such as the heat dissipation-preventing member 4 as in the first embodiment.

The planar heating element for a window according to the second embodiment can be fabricated as follows, for example. First, the heating element 2 formed of a conductive mesh having the notch 5 formed by cutting out a portion of the peripheral edge is prepared. Thereafter, by way of the step of installing the heating element (S10) and the step of installing the current supply portions (S20) as in the first embodiment, the planar heating element for a window according to the second embodiment can be fabricated. It is noted that the method of forming the notch 5 in the heating element 2 is not particularly limited. For example, the notch 5 can be formed by cutting out a portion of the peripheral edge of the conductive mesh using a conventionally known cutting method.

The second embodiment is otherwise the same as the first embodiment, and thus, the description thereof is not repeated.

Additional Description (1) The first aspect as one example of the present invention provides a planar heating element for a window including a resin base having a flat or curved surface; a heating element formed of a conductive sheet having a uniform specific resistance, the heating element being provided to spread in the form of a planar shape along a shape of the surface of the resin base, and a conductive current supply portion provided to extend in the form of a band on each of opposite ends of the heating element, so as to allow a current to pass through the heating element, the heating element having a locally increased specific resistance portion whose specific resistance locally increases when a current is passed through the heating element from the current supply portion. In the planar heating element for a window according to the first aspect of the present invention, a desired place on the surface of the planar heating element for a window can be preferentially heated with the locally increased specific resistance portion provided in the heating element, and then the entire surface of the planar heating element can be heated. Furthermore, the planar heating element for a window does not require the step of heating to a high temperature, e.g., 130° C. or higher, with a laser beam as in the conventional method described in PTD 1. A resin base can therefore be used as the base.

(2) In the first aspect of the present invention, the locally increased specific resistance portion is a portion of the heating element provided with a heat dissipation-preventing member that prevents escape of heat generated from the heating element by passage of a current to the heating element from the current supply portion. In this case, the portion of the heating element provided with the heat dissipation-preventing member is more unlikely to cause heat generated from the heating element to escape outside than the other regions. Therefore, the temperature of the portion of the heating element provided with the heat dissipation-preventing member is locally increased, causing the specific resistance thereof to locally increase. Thus, when a uniform current passes throughout the heating element 2, the amount of heat generated on the portion having the increased specific resistance is greater than the amount of heat generated on the other regions. In this case also, therefore, a desired place on the surface of the planar heating element for a window can be preferentially heated, and then the entire surface thereof can be heated.

(3) In the first aspect of the present invention, the locally increased specific resistance portion may be a portion of the heating element adjacent to a notch formed by cutting out a portion of a peripheral edge of the heating element, in a direction orthogonal to a direction of current flow in the heating element. In this case, the portion of the heating element adjacent to the notch is locally smaller in width in the heating element than the other regions. Therefore, the specific resistance of the portion of the heating element adjacent to the notch in the direction orthogonal to the direction of current flow is locally increased. Thus, when a uniform current passes throughout the heating element, the amount of heat generated on the portion having the increased specific resistance is greater than the amount of heat generated on the other regions. In this case also, therefore, a desired place on the surface of the planar heating element for a window can be preferentially heated, and then the entire surface thereof can be heated.

(4) In the first aspect of the present invention, the conductive sheet may be a conductive mesh including a plurality of first conductive wires extending at a distance from one another, and a plurality of second conductive wires extending at a distance from one another, the first conductive wires and the second conductive wires intersecting with one another to form openings. In this case also, a planar heating element for a window is provided in which a resin base is used, and a desired place can be preferentially heated and then the entire surface can be heated.

(5) In the first aspect of the present invention, the first conductive wires may extend in a first direction, the second conductive wires may extend in a second direction different from the first direction, and the conductive mesh may be formed by weaving the first conductive wires and the second conductive wires. In this case also, a planar heating element for a window is provided in which a resin base is used, and a desired place can be preferentially heated and then the entire surface can be heated.

(6) In the first aspect of the present invention, each of the first conductive wires may have a first core wire and a first coating material coating an outer surface of the first core wire, each of the second conductive wires may have a second core wire and a second coating material coating an outer surface of the second core wire, each of the first core wire and the second core wire may contain a resin, each of the first coating material and the second coating material may contain a conductive material, and the first conductive wires and the second conductive wires may be fixed to one another. In this case also, a planar heating element for a window is provided in which a resin base is used, and a desired place can be preferentially heated and then the entire surface can be heated.

(7) In the first aspect of the present invention, the conductive sheet may be a transparent conductive film. In this case also, a planar heating element for a window is provided in which a resin base is used, and a desired place can be preferentially heated and then the entire surface can be heated.

(8) A second aspect as one example of the present invention provides a window for a vehicle including the planar heating element for a window according to the first aspect of the present invention. The window for a vehicle according to the second aspect of the present invention, which includes the planar heating element for a window according to the first embodiment of the present invention, can be a resin window in which a desired place can be preferentially heated and then the entire surface can be heated. The resin window is very useful as a window for a vehicle because it achieves a significant decrease in weight while having transparency comparable to that of a glass window. Among windows for vehicles, each of the planar heating elements for windows according to the first and second embodiments is particularly suitable for use as a rear window for an automobile, because the central portion of the surface can be preferentially heated, and then the entire surface can be heated. As used herein, the window for a vehicle refers to a window used in a vehicle such as an automobile or the like. That is, by the window for a vehicle according to the second aspect of the present invention is meant that the planar heating element for a window according to the first aspect of the present invention itself is used as a window for a vehicle such as a rear window of an automobile, for example.

While the embodiments of the present invention have been described as above, it is originally intended to combine features of the foregoing embodiments as appropriate.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A planar heating element for a window comprising:

a resin base having a flat or curved surface;

a heating element formed of a conductive sheet having a uniform specific resistance, the heating element being provided to spread in the form of a planar shape along a shape of the flat or curved surface of the resin base; and a conductive current supply portion provided to extend in the form of a band on each of opposite ends of the heating element, so as to allow a current to pass through the heating element, the heating element having a locally increased specific resistance portion whose specific resistance locally increases when a current is passed through the heating element from the current supply portion, wherein the locally increased specific resistance portion is a portion of the heating element provided with a heat dissipation-preventing member that prevents escape of heat generated from the heating element by passage of a current to the heating element from the current supply portion.

2. The planar heating element for a window according to claim 1, wherein the locally increased specific resistance portion is a portion of the heating element adjacent to a notch formed by cutting out a portion of a peripheral edge of the heating element, in a direction orthogonal to a direction of current flow in the heating element.

3. The planar heating element for a window according to claim 1, wherein the conductive sheet is a conductive mesh including a plurality of first conductive wires extending at a distance from one another, and a plurality of second conductive wires extending at a distance from one another, the first conductive wires and the second conductive wires intersecting with one another to form openings.

4. The planar heating element for a window according to claim 3, wherein the first conductive wires extend in a first direction, the second conductive wires extend in a second direction different from the first direction, and the conductive mesh is formed by weaving the first conductive wires and the second conductive wires.

5. The planar heating element for a window according to claim 3, wherein each of the first conductive wires has a first core wire and a first coating material coating an outer surface of the first core wire, each of the second conductive wires has a second core wire and a second coating material coating an outer surface of the second core wire, each of the first core wire and the second core wire contains a resin, each of the first coating material and the second coating material contains a conductive material, and the first conductive wires and the second conductive wires are fixed to one another.

6. The planar heating element for a window according to claim 1, wherein the conductive sheet is a transparent conductive film.

7. A window for a vehicle comprising the planar heating element for a window according to claim 1.

* * * * *